US011276919B2

(12) United States Patent
Mayer Pujadas et al.

(10) Patent No.: US 11,276,919 B2
(45) Date of Patent: Mar. 15, 2022

(54) RADOME FOR VEHICLES

(71) Applicant: ZANINI AUTO GRUP, S.A., Parets del Valles (ES)

(72) Inventors: Augusto Mayer Pujadas, Barcelona (ES); José Sanahuja Clot, Barcelona (ES)

(73) Assignee: ZANINI AUTO GRUP, S.A., Barcelona (ES)

( * ) Notice: Subject to any disclaimer, the term of this patent is extended or adjusted under 35 U.S.C. 154(b) by 0 days.

(21) Appl. No.: 16/344,351

(22) PCT Filed: Oct. 24, 2017

(86) PCT No.: PCT/EP2017/077062
§ 371 (c)(1),
(2) Date: Apr. 23, 2019

(87) PCT Pub. No.: WO2018/077827
PCT Pub. Date: May 3, 2018

(65) Prior Publication Data

US 2020/0052395 A1 Feb. 13, 2020

(30) Foreign Application Priority Data

Oct. 24, 2016 (EP) ..... 16195218

(51) Int. Cl.
*H01Q 1/32* (2006.01)
*H01Q 1/42* (2006.01)

(52) U.S. Cl.
CPC ..... *H01Q 1/422* (2013.01); *H01Q 1/32* (2013.01); *H01Q 1/421* (2013.01)

(58) Field of Classification Search
CPC ..... H01Q 1/422; H01Q 1/32; H01Q 1/421
See application file for complete search history.

(56) References Cited

U.S. PATENT DOCUMENTS

| | | | |
|---|---|---|---|
| 2,595,331 | A | 5/1952 | Calihan |
| 5,806,957 | A | 9/1998 | Prior |
| 2004/0080958 | A1 | 4/2004 | Bukosky |
| 2007/0114322 | A1 | 5/2007 | Smereczniak |
| 2008/0063874 | A1 | 3/2008 | Rakow |

(Continued)

FOREIGN PATENT DOCUMENTS

DE 102014002438 A1 8/2015

OTHER PUBLICATIONS

International search report for PCT/EP2017/077062, dated Jan. 17, 2018, 1 pages.

(Continued)

*Primary Examiner* — Awat M Salih
(74) *Attorney, Agent, or Firm* — Danielson Legal LLC

(57) ABSTRACT

The radome for vehicles comprises a substrate (1) and a cover (2) joined to each other, said radome defining a field of view (F) for a radar, and it is characterized in that the substrate (1) and the cover (2) are made from the same material and in that the substrate (1) and the cover (2) are joined to each other by welding and by a sealing element (4), said sealing element (4) being placed outside said field of view (F). The attachment process is simplified by transferring the water tightness responsibility to the sealing element, while the welding provides the attachment control between the different parts.

6 Claims, 1 Drawing Sheet

(56) References Cited

U.S. PATENT DOCUMENTS

| | | | | |
|---|---|---|---|---|
| 2008/0149318 | A1 | 6/2008 | Dakhoul | |
| 2008/0309579 | A1 | 12/2008 | Maeda | |
| 2010/0321952 | A1 | 12/2010 | Coleman | |
| 2012/0119961 | A1* | 5/2012 | Mayer Pujadas .... | H01Q 1/3283 343/713 |
| 2012/0294030 | A1 | 11/2012 | Okada | |
| 2012/0320615 | A1 | 12/2012 | Englert | |
| 2013/0201709 | A1 | 8/2013 | Natsume | |
| 2015/0025788 | A1 | 1/2015 | Crain | |
| 2015/0349399 | A1 | 12/2015 | Lasier | |
| 2017/0352938 | A1* | 12/2017 | Okumura ..... | B60S 1/66 |
| 2017/0357044 | A1 | 12/2017 | Kuramitsu | |
| 2018/0090832 | A1* | 3/2018 | Takahashi ..... | B60R 13/005 |
| 2018/0254551 | A1* | 9/2018 | Guretzky ..... | G01S 7/032 |

OTHER PUBLICATIONS

Office Action for U.S. Appl. No. 16/474,230, dated Jun. 12, 2020, 13 pages.
Office Action for U.S. Appl. No. 16/556,748, dated Dec. 1, 2020, 13 pages.

* cited by examiner

RADOME FOR VEHICLES

CROSS REFERENCE TO RELATED APPLICATIONS

This application is the national phase of International (PCT) Patent Application No. PCT/EP2017/077062, filed internationally on Oct. 24, 2017, which claims the benefit of and priority to European patent application no. 16195218.9, filed with the European Patent Office on Oct. 24, 2016, the entire disclosure of each of which is hereby incorporated by reference in their entirety.

The present invention refers to a radome for vehicles, representing a logo or an emblem to be placed in the frontal part of the vehicle concealing a radar.

BACKGROUND OF THE INVENTION

Decorative radomes for automotive applications representing a logo or an emblem are usually comprised of a substrate, a decoration layer and a cover. There are several reasons for this.

First, the decoration layer is preserved from environmental or chemical degradation by being sandwiched between two elements (substrate and cover).

Second, it becomes easier to accomplish different colors, volumetric 3D perception, and other trimming details to allow branding identification. Therefore, the substrate and the cover can be formed with complementary indentations and recesses according to the brand logo. The reason for this is that hard edges or steps can be overcome if the gap between the complementary structures of cover and substrate is zero or much smaller than the radar wave length. The presence of this kind of artifacts would lead to diffraction of radar waves, affecting the main functionality of the radar. This way the radome offers a homogeneous medium in order to minimize distortion of radar waves going through. There are several points that have to be considered:

To achieve maximum transparency to radar waves, radome thickness has to be a multiple of the wave semi-wave length in the medium. If this is accomplished, cancellation of the reflected waves towards the radar at the radome interfaces occurs and radar functionality is preserved.

Given that in all radome interfaces transmission and reflection of electromagnetic waves occur, a radome properly designed would maximize transmission and minimize reflection by calculating the proper radome thickness. To do so, dielectric material properties of both cover and substrate have to be carefully determined, more specifically the material complex permittivity.

The incidence angle with respect to a vector normal to the radome surface has also to be taken into account. If both considerations are taken into account the radome is adapted in the electromagnetic sense and, furthermore, minimum distortion affects radar waves.

If the parts of the radome are made of different materials adaptation will be more difficult, given each material possesses its own complex permittivity. This would lead to suboptimal radome performance, since some resin layer thicknesses will not be adapted. Nevertheless, this may be necessary in some cases. Hence, the complex permittivity of each material have to be employed when the thickness of each part are determined.

The existence of a gap between the different parts of the radome has negative effects on radar wave propagation:

As the number of media increases, so does the number of interfaces and the adaptation will also be more difficult, and more transmissions and reflections will have to be accounted for. If the gap existing between substrate and cover is not small in terms of the radar wave length, the gap will account for another medium, and worse radar performance will be attained.

A variable gap thickness distorts the radar wave propagation, as the different optical paths throughout the radome modify the phase and amplitude of the waves.

Depending on the water absorption properties of some resin materials, or the water tightness of the assembled radome, water may ingress in the gap.

All of the possibilities mentioned above degrade radar performance. Hence, the gap between substrate and cover has to be minimized and kept as constant and small as possible. If the existing gap is a small fraction of the radar wave wave length or less, its impact on the radar wave propagation is negligible.

These effects can be addressed by designing a robust attachment method for the radome assembly. Thus, it is clear that the attachment of the different parts composing the radome is one of the key points of the radome design.

Several methods are known to attach the different radome elements together. One possibility for a mechanical attachment involves additional elements on the outer perimeter of the radome, outside the radar Field of View, such as a clip or a ring. These outer elements would ideally hold all inner elements, those inside the radar antennas Field of View, tightly together. The inner elements, i.e. inside the radar Field of View, are adapted to the radar wave length. The outer elements, i.e. outside radar Field of View, are not adapted to the radar wave length, but the distortion they introduce to radar waves does not degrade radar performance. Hence, design constraints such as adapted radome thickness, homogeneous surface, or the employment of materials with suited complex permittivity do not apply to the outer elements. This method of attaching the radome does not, however, ensure water tightness: water may eventually ingress through joints or cracks and could fill existing gaps between the inner radome elements.

Another mechanical method is molding the different parts successively one over the other. Several indentations and recesses can be formed at the interfaces to ensure a tight attachment of the different elements. Different materials with different melting temperatures are employed in this radome construction. The reason is, being the radome a decorative element, deformations in the decoration shapes or contours contained in the part molded in the first place have to be avoided. Thus, the part molded in the second place requires a lower melting temperature.

An added complexity comes from the fact that decoration layers sandwiched between the two molded parts need to be protected during the over molding. So the melting temperature of the part molded in the second place needs to be low enough so as not to damage the decoration layer applied over the part molded in the first place.

In this scenario, due to different material shrink rates, gaps may be formed between the several parts and water may ingress inside the radome. Besides, cracks between the different parts appearing over time may affect radome performance and decoration.

Therefore, it is clear that the attachment of the different radome elements is a problem of significant complexity.

DESCRIPTION OF THE INVENTION

With the radome of the invention said drawbacks can be solved, presenting other advantages that will be described hereinafter.

The radome for vehicles according to the present invention comprises a substrate and a cover joined to each other, said radome containing the Field of View of a radar, and it is characterized in that the substrate and the cover are made from the same material or, in certain cases, by different materials that are welding compatible and that are suited for radar wave transmission. The substrate and the cover are joined to each other by welding and by a sealing element, said sealing element being placed outside said Field of View.

Preferably, the substrate and the cover are made from thermoplastic resins such as acrylonitrile styrene acrylate (ASA), acrylic resin, polystyrene, polyvinyl chloride (PVC), polycarbonate (PC), polyurethane, acrylonitrile butadiene styrene (ABS) or acrylonitrile ethylene styrene (AES), and said sealing element is glue and/or a joint.

According to a preferred embodiment, the substrate and the cover are welded by a plurality of welding tracks or spots, and said welding tracks or spots can be placed inside and outside said Field of View.

If the same material is used in all radome elements, several advantages are achieved: First, optimal radome thickness adaptation can be achieved and, furthermore, optimal electromagnetic performance attained. Second, welding compatibility is ensured. In cases where different materials are used, each part thickness needs to be matched individually by employing the corresponding complex permittivity to determine the matching thickness and to ensure the best possible electromagnetic performance.

Moreover, welding compatibility must be ensured between the employed materials.

Provided the radome surface exceeds the contour defined by the radar Field of View, water tightness among the elements composing the radome can be attained by means of the sealing element, such as a joint or glue. The joint or glue is placed outside the radar Field of View, because it would distort radar wave propagation otherwise.

All over the radome surface, several welding tracks or spots must be placed to ensure a tight attachment of the radome elements and minimal, constant gap on the whole radome. Hence, radome overall thickness can be controlled very accurately by the presence of said welding tracks and spots, and excellent radar wave transparency attained throughout the whole radome. These welding tracks or spots provide a chemical attachment mechanism, extremely robust to wear and tear and also to chemical attacks. Moreover, they do not modify the transmission of radar waves throughout the radome body because no additional elements are involved and the materials employed in both substrate and cover keep the same properties before and after the welding process occurs.

In this way, the attachment process is simplified by transferring the water tightness responsibility to the sealing element, while the welding provides the attachment control between the different parts. Proper distribution of welding spots or tracks must be selected as a function of the logo geometry. In this way, even for large, curved radomes, zero or minimum constant gap can be attained.

BRIEF DESCRIPTION OF THE DRAWINGS

For a better comprehension of what has been disclosed, some drawings are attached in which, diagrammatically and only as a non-limitative example, a practical embodiment is shown.

DESCRIPTION OF A PREFERRED EMBODIMENT

Figure 1:
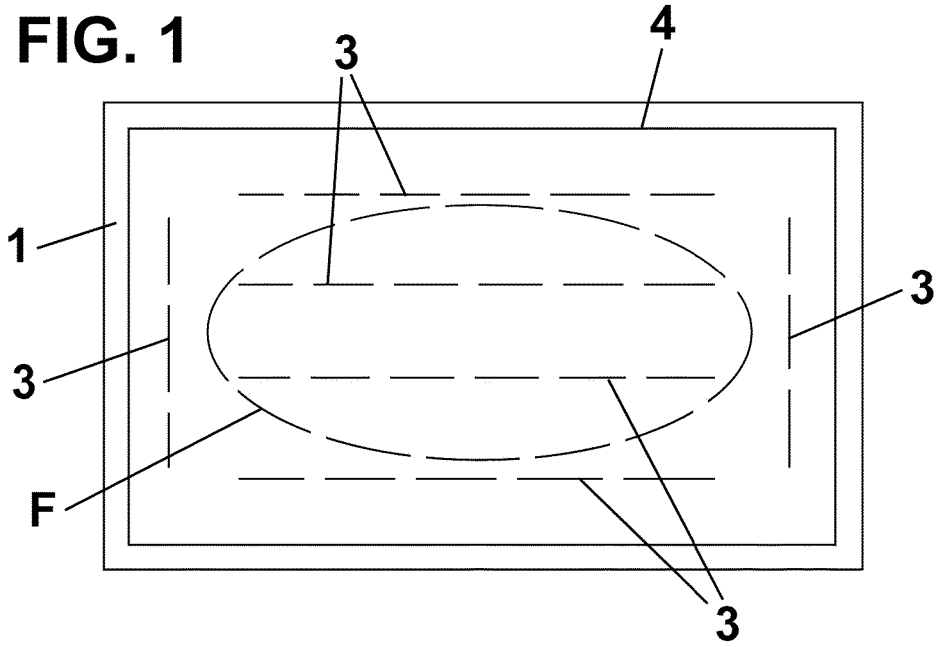
FIG. 1 is a frontal view of the radome according to the present invention.
Figure 2:
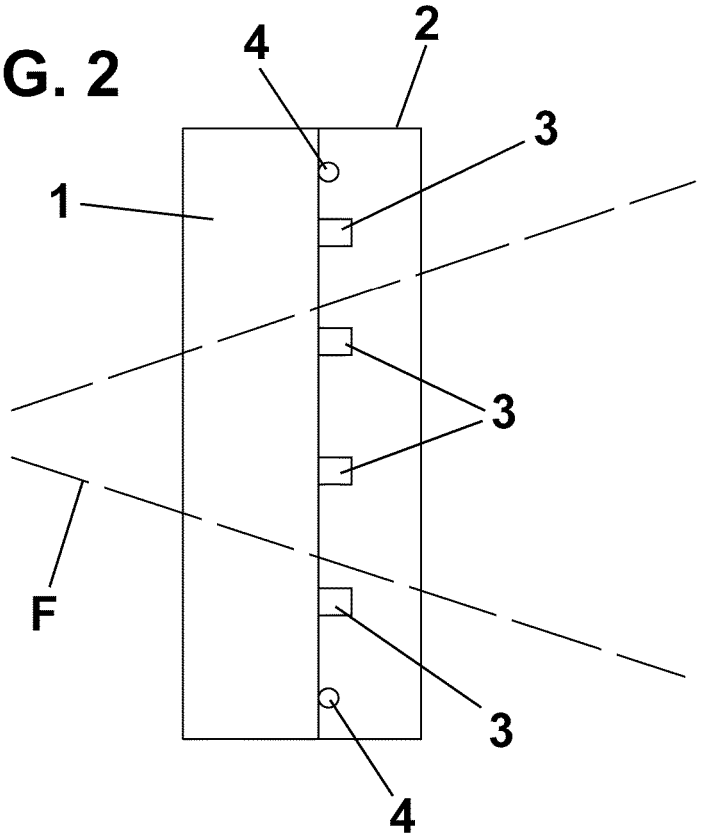
FIG. 2 is a cross-section lateral view of the radome according to the present invention.

The radome for vehicles according to the present invention is usually used in the frontal panel of a vehicle, where a radar is also installed, so that the radar waves cross through the radome. To this end, the radome defines a radar Field of View (identified by letter F in the drawings), i.e. a zone through which is intended the passage of the radar waves. This zone must be free of elements that prevents or affects the passage of the radar waves.

The invention according to the present invention comprises a substrate 1 and a cover 2, and it also comprises preferably a decoration layer, not shown in the drawings.

The substrate 1 and the cover 2 are attached to each other and are preferably made from the same material or from welding compatible materials, such as e.g. acrylonitrile styrene acrylate (ASA), acrylic resin, polystyrene, polyvinyl chloride (PVC), polycarbonate (PC), polyurethane, acrylonitrile butadiene styrene (ABS) or acrylonitrile ethylene styrene (AES), but they could be made from any suitable material. If the substrate 1 and the cover 2 are made from different materials, the substrate 1 can be made from polycarbonate and the cover 2 can be made from acrylonitrile styrene acrylate, just as an example.

The substrate 1 and the cover 2 are attached to each other by welding, by a plurality of welding tracks or welding spots 3, and by a sealing element 4. This sealing element 4 can be glue or a joint, and its function is to guarantee the water tightness among the radome elements. The welding can be done by laser or by infrared.

The welding tracks or spots 3 are preferably placed inside and outside the radar Field of View F, even though they can be placed in any suitable position for permit a correct welding between the substrate 1 and the cover 2.

On the other hand, the sealing element 4 is placed outside the radar Field of View F, because it could affect the crossing of the radar waves if it would be placed inside the radar Field of View F.

Thanks to the use of the same material for the substrate 1 and the cover 2, an optimal electromagnetic performance is attained and welding compatibility is ensured. If different materials are employed in substrate 1 and cover 2, excellent electromagnetic performance is nevertheless attained due to the fact that robust attachment mechanisms will keep both parts tight together and that water tightness is ensured to the whole radome.

Even though reference is made to a specific embodiment of the invention, it is clear for a person skilled in the art that the disclosed radome is susceptible of variations and modifications, and that all the details cited can be substituted by other technically equivalent ones, without departing from the scope of protection defined by the attached claims.

The invention claimed is:

1. Radome for vehicles, comprising a substrate (1) and a cover (2) joined to each other, said radome defining a field of view (F) for a radar, characterized in that the substrate (1) and the cover (2) are joined to each other by welding and by a sealing element (4), said sealing element (4) being placed outside said field of view (F), wherein the substrate (1) and the cover (2) are welded together by at least two welding segments (3) that are separated from each other and said welding segments (3) are placed inside and/or outside said field of view (F).

2. Radome for vehicles according to claim 1, wherein the substrate (1) and the cover (2) are made from the same material.

3. Radome for vehicles according to claim 1, wherein the substrate (1) and the cover (2) are made from different materials.

4. Radome for vehicles according to claim 1, wherein the substrate (1) and the cover (2) are made from acrylonitrile styrene acrylate (ASA), acrylic resin, polystyrene, polyvinyl chloride (PVC), polycarbonate (PC), polyurethane, acrylonitrile butadiene styrene (ABS) or acrylonitrile ethylene styrene (AES).

5. Radome for vehicles according to claim 1, wherein said sealing element (4) is glue and/or a joint.

6. Radome for vehicles according to claim 1, wherein the sealing element (4) is configured to create a water-tight seal between the substrate and the cover.

* * * * *